US005400906A

United States Patent [19]

Tang

[11] Patent Number: 5,400,906

[45] Date of Patent: Mar. 28, 1995

[54] BAG HAVING EXPANDING MEANS THEREIN

[76] Inventor: Hin M. Tang, 10 Banksia Street, Eastwood NSW 2122, Australia

[21] Appl. No.: 231,204

[22] Filed: Apr. 21, 1994

[51] Int. Cl.[6] ..... B65D 33/02

[52] U.S. Cl. ..... 206/457; 206/44 R; 383/2

[58] Field of Search ..... 206/44, 457; 220/9.2, 220/9.3; 383/2-4

[56] References Cited

U.S. PATENT DOCUMENTS

| | | | |
|---|---|---|---|
| 1,206,618 | 11/1916 | Thrasher | 220/9.2 |
| 2,542,477 | 2/1951 | Cart | 383/4 |
| 4,077,451 | 3/1978 | Zoland | 150/31 |
| 4,141,399 | 2/1979 | Zoland | 150/31 |
| 4,796,734 | 1/1989 | Distasio | 383/4 |
| 4,813,520 | 3/1989 | Lin | 220/9.3 |
| 4,946,292 | 8/1990 | Diamond et al. | 383/127 |
| 4,949,401 | 8/1990 | Kimsey, Jr. | 383/4 |
| 4,953,673 | 9/1990 | Ambasz | 383/2 |
| 4,969,751 | 11/1990 | Diamond et al. | 383/127 |
| 4,993,846 | 2/1991 | Diamond et al. | 383/127 |
| 5,090,526 | 2/1992 | Jacober | 383/2 |

*Primary Examiner*—Jimmy G. Foster
*Attorney, Agent, or Firm*—Joel F. Spivak

[57] ABSTRACT

An apparatus for insertion into and expansion of a soft bag or backpack has a relatively flat foldable member comprising four parallel fold lines forming five panels. A rubber band is connected across each end panel and the panel adjacent thereto so as to urge the member to fold along the fold lines therebetween. The bag is caused to be expanded by the apparatus when the rubber bands cause the member to fold in a position to form a pair of gable-like structures which force the sides of the bag outwardly while the center section of the member rests against a major surface of the bag. The apparatus may be retained in the bag in a flat state for shipping.

13 Claims, 3 Drawing Sheets

BAG HAVING EXPANDING MEANS THEREIN

FIELD OF THE INVENTION

This invention relates to expandable soft bags or back-packs for display at the point of sale. More particularly, this invention relates to a soft bag having an apparatus therein which either automatically or manually expands the bag to give the impression that the bag is filled.

BACKGROUND OF THE INVENTION

Soft bags, such as suitcases, tote bags, sport bags and back-packs, of all sizes and types are presently manufactured throughout the world. The bags are transported from the manufacturer to their destination in a flatly packed or nested state so as to take up minimal shipping space thereby reducing the cost of shipping. As most retailers prefer to sell and/or display these bags fully stuffed for marketing purposes, the retailer often arranges for the bags to be stuffed and repacked at a stuffing facility located near the final destination or at the point of sale. To accomplish this, the bags must be removed from their original shipping cartons, manually stuffed, such as with crumpled paper, stiff cardboard, inflated members or other means, and then repacked in larger cartons that will hold the stuffed bags. Such stuffing increases the cost of the bags and additionally creates storage problems.

As a result of the problems associated with manually stuffed bags, there has been introduced into the market insertable apparatus that permits a bag to be retained in a flat state for shipping and then, automatically or manually, allows the bag to be easily and quickly expanded by the retailer. Such insertable apparatus eliminates the costly stuffing process for display or sales purposes while still retaining the savings associated with the ability to ship or store the bags in a flat state. Typically, such expandable member has been made from corrugated cardboard and is urged into the desired state by appropriately positioned resilient means, e.g. rubberbands. Exemplary of such apparatus are those described in U.S. Pat. Nos. 4,077,451; 4,141,399; 4,946,292; 4,969,751; and 4,993,846.

While the insertable apparatus set forth in these patents are adequate to fulfill the need for an alternative to stuffing, simpler, less costly and/or more effective designs are always desirable.

SUMMARY OF THE INVENTION

The present invention comprises a foldable and expandable apparatus used in combination with, and insertable in, a soft bag for allowing the bag to be shipped in a compact, flat state and to be later automatically or manually changed to an expanded state. The apparatus comprises a unitary flat foldable member having resilient or elastic actuating means. The unitary flat foldable member is provided with four parallel, spaced, fold lines so as to form five panels including a main center panel which preferably conforms to the shape of a major face of the bag into which it is to be inserted. Adjacent the center panel are two pairs of side panels one pair on each side of the center panel. Each pair of side panels is comprised of an end panel and a second panel between it and the center panel. The two end panels of each pair of side panels and either the respective adjacent side panel or the center panel is provided with means for securing the elastic member thereacross in a manner so as to allow the member to be maintained in a relatively flat state, with or without external force being applied thereto, and thereafter to automatically or manually be urged and retained by said elastic means in an expanded state. In the expanded state, each pair of side panels forms a gable-like structure which lies transverse to the plane of the center panel thereby urging the bag to expand and appear filled.

DETAILED DESCRIPTION OF THE INVENTION

Figure 1:
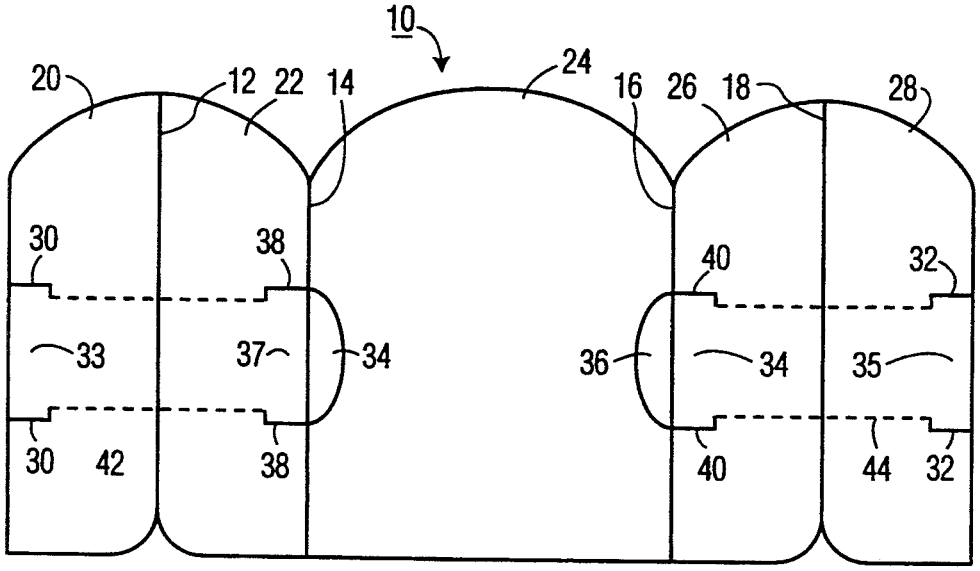
FIG. 1 is a top plan view of an embodiment of the invention showing the bag insertion member in a flat position, without any resilient means attached thereto. The placement of the resilient means (e.g. elastic or rubber bands) are shown in phantom.

As shown in FIG. 1, the present invention comprises a relatively flat and foldable member 10 which may be made from cardboard or other suitable rigid material having four parallel, spaced fold lines 12, 14 16 and 18 which divide the member into five panels 20, 22, 24 26 and 28. Center panel 24 is preferably shaped to conform to the shape of a major surface of a bag 50 to be expanded. End panel 20 and adjacent panel 22 having fold line 12 therebetween forms a first pair of side panels. Panel 26 and end panel 28 adjacent thereto have a fold line 18 therebetween to form a second pair of side panels. Each pair of side panels lie on different sides of the center panel 24. The width of each pair of side panels is preferably smaller than the width of the center panel 24. However, depending upon the dimensions of the bag 50 to be expanded, the pairs of side panels may be the same size as, or larger than, the center panel 24. However, if larger than the center panel the member should be inserted in the bag 50 with the side panels folded (see FIG. 2 (*b*)). The member 10 can be constructed of a heavy cardboard, corrugated board or other suitable generally rigid material including plastics.

End panels 20 and 28 are each provided with a pair of spaced parallel slits 30 and 32 respectively, extending inwardly from their outer edges so as to form tabs 33 and 35, respectively. Center panel 24 is provided with cut-outs 34 and 36 which are centrally located along the side edged (along fold lines 14 and 16 respectively) of the center panel 24. Adjacent the outer edges of each cut-out 34 and 36 is a pair of spaced parallel slits 38 and 40 extending inwardly from the fold lines 14 and 16 into panels 22 and 26 respectively, so as to form tabs 37 and 39. The pairs of side panels may also be shaped to conform to the shape of the bag 50. The tabs 33 and 37 provide means onto which a first rubber band 42 is looped around so as to urge panels 20 and 22 to fold along fold line 12. Similarly, tabs 35 and 39 provide means onto which a second rubber band 44 is looped around so as to urge panels 26 and 28 to fold along fold line 18. The cut-outs 34 and 36 facilitate the attachment of the rubber bands 42 and 44 to the tabs of the member 10.

Figure 2A:
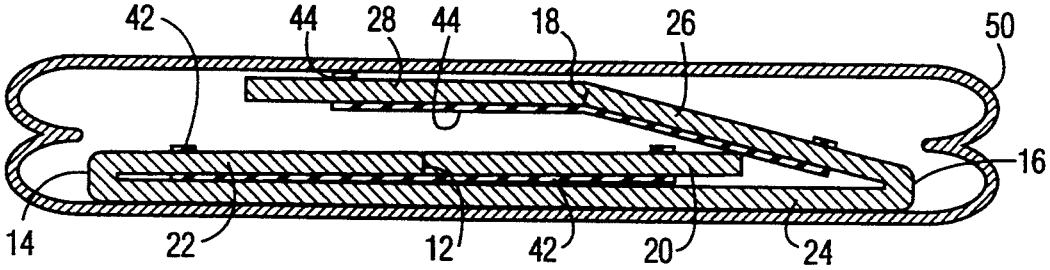
FIGS. 2(*a*) and 2(*b*) are side views of the embodiment of FIG. 1 inserted in a soft bag with attached rubber bands, showing various ways the insertable member may be folded within the bag to allow the bag to be shipped in a collapsed or flat state.
Figure 2B:
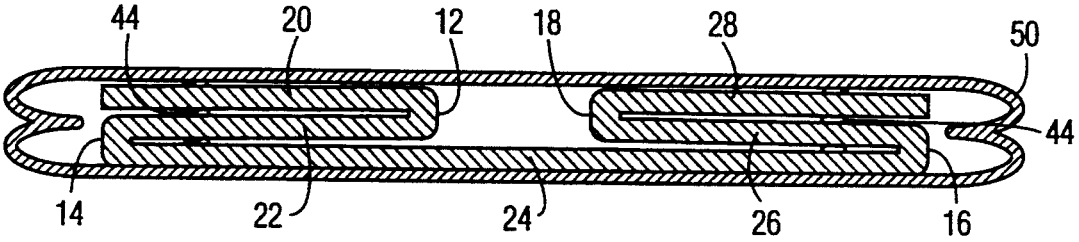

When the member 10, with the rubber bands attached, is inserted into a soft bag 50, as shown in FIG. 2(*a*) so as to lie flat so that the bag can be shipped in a flat state, the rubber bands 42 and 44 are stretched and the member 10 is folded only along fold lines 14 and 16, whereby the first pair of panels, panels 20 and 22, are overlapped by the second pair of panels, panels 26 and 28, both pairs of panels being folding inwardly over the center panel 24. In order to maintain the member 10 in this folded, flat state, it is necessary to exert a force on the member 10 perpendicular to the plane of the member 10 so as to counteract the force of the rubber bands urging the panels to fold along fold lines 12 and 18. During shipment from the manufacturer, bag 50 will be placed flat in a container with other bags. The container will be completely filled with bags to maximize shipping space and reduce shipping costs. If the bags contain the apparatus of this invention folded as shown in FIG. 2(*a*), the apparatus will be maintained in a compressed state due to the filled container which provides the force necessary to counteract the force of the rubber bands and hence will be retained in their flat configuration. Upon removal from the container, the compressive force will be relieved and the two pair of end panels will be urged by the rubber bands to assume a position as described in FIG. 3(*a*), giving the bag a filled appearance. It should be noted that to insure more uniform bag expansion rigid inserts may be added to the expanded bag to supplement the novel apparatus.

Alternatively, the apparatus may be inserted into the bag as shown in FIG. 2(*b*). In this configuration, the pairs of side panels are urged together by the rubber bands so as to fold along fold lines 12 and 18. The folded pairs of side panels is then also caused to be manually folded along fold lines 14 and 16 inwardly over the center panel 24. The apparatus is retained in this flat position without the need for any external force. This facilitates packing by the manufacturer. However, this configuration requires the retailer to manually maneuver the panels into one of the configurations shown in FIG. 3(*a*) or 3(*b*) when he wants the bag to assume the expanded state, Referring to FIG. 3(*a*), the bag 50 having apparatus 10 therein is shown in an expanded state, Here, upon removing the bag 50 from the container so as to remove the force which retains the bag 50 and apparatus 10 in their flat states, the tension on the stretched rubber bands 42 and 44 causes the pairs of side panels to which they are attached to automatically fold along fold lines 12 and 18, respectively so as to form a pair of gable-like side walls which keep the bag 50 in an expanded state. When the end panels 20 and 28 are wider than the panel 22 and 26 which are respectively adjacent to them, the edges of the end panels 20 and 28 become lodged against the center panel 24 so as to form a wider, more stable gable-like structure.

Figure 3A:
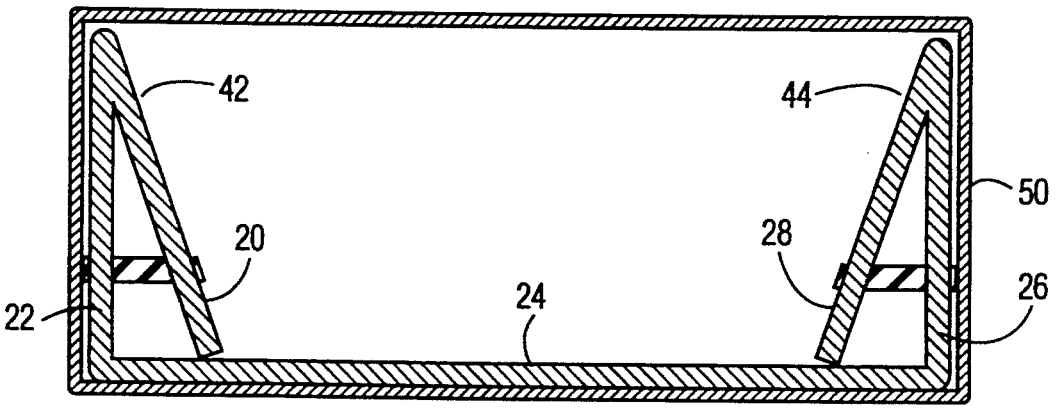
FIGS. 3(*a*) and 3(*b*) are side views of the embodiment of FIG. 1, with attached rubber bands showing the member and bag in their expanded states.
Figure 3B:
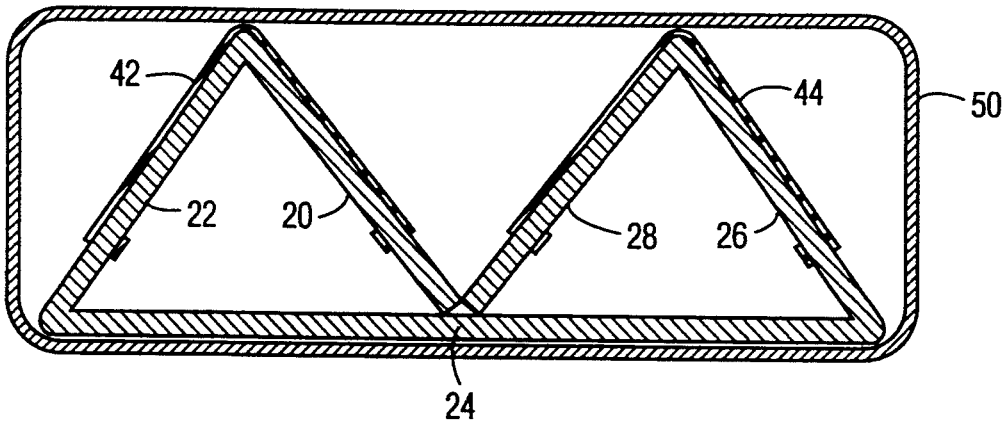

When the apparatus is inserted into the bag 50 as shown in FIG. 2(*b*), the apparatus can be manually folded to attain the expanded configuration shown in either FIG. 3(*a*) or 3(*b*). In the configuration shown in FIG. 3(*b*), the rubber bands 42 and 44 urge the end panels 20 and 28 in a direction as shown by the arrows so that they wedge against each other forming the dual triangular shape shown which acts to maintain the bag 50 in its expanded state.

Figure 4:
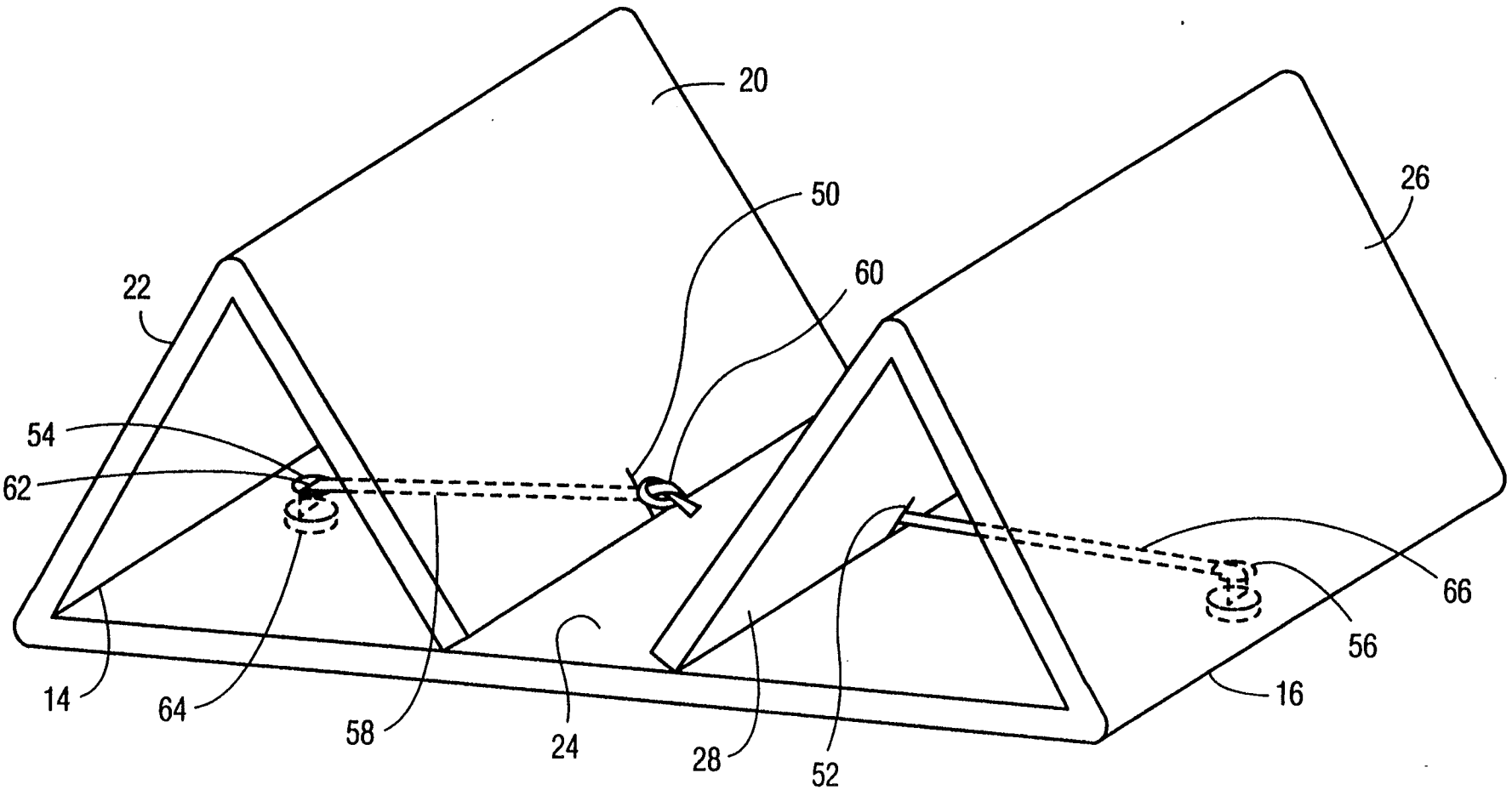
FIG. 4 is an isometric view of a modified version of the previously described embodiment.

FIG. 4 shows a modification of the device described in the previously described embodiment. More particularly, the expander of FIG. 4 employs an alternative elastic member and an alternative mode and point of attachment of the elastic member. Referring to the Figure, the end panels 20 and 28 are each provided with a single slit 50 and 52 respectively, which extends inwardly from the mid portion of the edge of the respective panel. Center panel 24 is provided with a pair of holes 54 and 56 located a short distance from the fold lines 14 and 16 along the horizontal mid line of the center panel 24. A first elastic member 58 has one end 60 thereof inserted through the slit 50 in panel 20 and knotted so as to be retained therein. The other end 62 of elastic member 58 is inserted through the left hole 54 in the center panel 24 and retained by means of a retaining button 64. It will be understood that any retaining means is suitable, e.g. staples rivets or other attachment means, with or without the slits and/or holes. A second elastic member 66 is similarly attached to the slit 52 of panel 28 and the right hole 56 in center panel 24, as shown. In use, a compressive force is necessary to maintain the apparatus in a flattened state. Upon removal of the compressive force, the stretched elastic members urge the end panels and their adjacent panels to automatically fold along the respective fold lines to form a pair of gable-like structures which expands the soft bag into which the apparatus is placed.

While specific embodiments have been described, all modifications and equivalents of such embodiments which fall within the principles of the invention are intended to be covered within the spirit and scope of the invention by the appended claims.

What is claimed is:

1. A bag expanding device in combination with a soft bag comprising:

a soft bag having a major surface and an expandable compartment such that the bag can assume a collapsed, flat state or an expanded state;

a bag expanding device inserted in the compartment such that the bag can assume its collapsed shape during shipping in a shipping container, and then either automatically or manually be caused to assume its expanded shape upon removal from the shipping container, the bag expanding device comprising a unitary, flat foldable member having resilient actuating means associated therewith for urging the member to fold into a predetermined shape, said member having four parallel, spaced fold lines so as to form five panels including a center panel, a left end panel and a panel adjacent thereto forming a first pair of panels and a right end panel and a panel adjacent thereto forming a second pair of panels, attachment means on each pair of panels for attaching resilient means thereto;

a first resilient means attached to said attachment means of said first pair of panels and extending across the fold line between the panels comprising said pair;

a second resilient means attached to said attachment means of said second pair of panels and extending across the fold line between the panels comprising said second pair of panels; said first and second resilient means urging the panels comprising the first and second pair of panels to fold along the respective fold lines between said panels.

2. The combination recited in claim 1 wherein the expanding device is inserted in the bag for shipping in a manner such that a compressive force must be maintained on the device to maintain the bag and device in a flat state and when said force is removed, the resilient means automatically urges the device to fold in a manner as to cause and maintain expansion of the bag.

3. The combination recited an claim 1 wherein the expanding device is inserted in the bag for shipping in a manner such that no compressive force is required to maintain the bag and device in a flat state and when desired, the device is manually manipulated so as to cause the bag to assume an expanded state.

4. The combination recited in claim 1 wherein the center panel of the expanding device conforms to the shape of a major surface of the bag.

5. The combination recited in claim 1 wherein the expanding device is made of a cardboard and the resilient means are rubber bands.

6. The combination recited in claim 4 wherein the expanding device is made of corrugated cardboard.

7. The combination recited in claim 1 wherein the expanding device form a pair of gable-like members which act to expand the bag when in the expanded state.

8. The combination recited in claim 1 wherein the attachment means comprises tabs on each of said pairs of panels.

9. The combination recited in claim 8 wherein said tabs are formed by means of parallel slits extending inwardly from the outer edges of the end panels and inwardly from the inner edges of the panels adjacent said end panels.

10. The combination recited in claim 9 wherein the resilient means are rubber bands and the center panel of the expanding device includes a pair of cut-outs adjacent the slits in the panels adjacent the center panel to facilitate attachment of the rubber band to the tabs formed by said slits.

11. The combination recited in claim 1 wherein the end panels are wider than the panels adjacent thereto.

12. A bag expanding device in combination with a soft bag comprising:

a soft bag having a major surface and an expandable compartment such that the bag can assume a collapsed, flat state or an expanded state;

a bag expanding device inserted in the compartment such that the bag can assume its collapsed shape during shipping in a shipping container, and automatically be caused to assume its expanded shape upon removal from the shipping container, the bag expanding device comprising a unitary, flat foldable member having resilient actuating means associated therewith for urging the member to fold into a predetermined shape, said member having four parallel, spaced fold lines so as to form five panels including a center panel, a left end panel and a panel adjacent thereto forming a first pair of panels and a right end panel and a panel adjacent thereto forming a second pair of panels;

first and second attachment means, one on each end panel, for attaching one end of a resilient member thereto;

third and fourth attachment means on the center panel adjacent each fold line of the center panel for attaching the respective other end of each resilient member thereto;

a first resilient member attached by said first and third attachment means between said left end panel and said center panel;

a second resilient member attached by said second and fourth attachment means between said right end panels and said center panel;

said resilient means urging the panels to fold along the respective fold lines between said panels to form a pair of gable-like structures in the absence of a compressive force which structures act to expand the bag.

13. A bag expanding device in combination with a soft bag comprising:

a soft bag having a major surface and an expandable compartment such that the bag can assume a collapsed, flat state or an expanded state;

a bag expanding device inserted in the compartment such that the bag can assume its collapsed shape during shipping in a shipping container, and then either automatically or manually be caused to assume its expanded shape upon removal from the shipping container, the bag expanding device comprising a unitary, flat foldable member having resilient actuating means associated therewith for urging the member to fold into a predetermined shape, said member having four parallel, spaced fold lines so as to form five panels including a center panel, a left end panel and a panel adjacent thereto forming a first pair of panels and a right end panel and a panel adjacent thereto forming a second pair of panels, a plurality of attachment means for attaching resilient means thereto;

a first resilient means attached to said attachment means and extending across at least one fold line between panels;

a second resilient means attached to said attachment means and extending across at least one other fold line between the other panels; said first and second resilient means urging the respective panels comprising the first and second pair of panels to fold along the respective fold lines between said panels so as to cause expansion of the bag.

* * * * *